US006139390A

United States Patent [19]

Pothoven et al.

[11] Patent Number: 6,139,390

[45] Date of Patent: Oct. 31, 2000

[54] LOCAL ENERGY ACTIVATION OF GETTER TYPICALLY IN ENVIRONMENT BELOW ROOM PRESSURE

[75] Inventors: Floyd R. Pothoven, Hawthorne; Anthony J. Cooper, Escondido; Igor L. Maslennikov, Cupertino, all of Calif.

[73] Assignee: Candescent Technologies Corporation, San Jose, Calif.

[21] Appl. No.: 08/766,668

[22] Filed: Dec. 12, 1996

[51] Int. Cl.[7] ..... H01J 9/38

[52] U.S. Cl. ..... 445/41; 445/24; 445/55

[58] Field of Search ..... 445/24, 41, 55

[56] References Cited

U.S. PATENT DOCUMENTS

| | | | |
|---|---|---|---|
| 2,855,368 | 10/1958 | Perdijk, Jr. et al. | 252/181.6 |
| 4,131,487 | 12/1978 | Pearce et al. . | |
| 4,257,827 | 3/1981 | Schwuttke et al. . | |
| 4,683,154 | 7/1987 | Benson et al. | 428/34 |
| 4,925,741 | 5/1990 | Wong | 428/661 |
| 5,223,766 | 6/1993 | Nakayama et al. | 313/495 |
| 5,424,605 | 6/1995 | Lovoi . | |
| 5,453,659 | 9/1995 | Wallace et al. . | |
| 5,477,105 | 12/1995 | Curtin et al. . | |
| 5,519,284 | 5/1996 | Pepi . | |
| 5,525,861 | 6/1996 | Banno et al. | 313/495 |
| 5,545,946 | 8/1996 | Wiemann et al. . | |
| 5,548,181 | 8/1996 | Jones | 313/309 |
| 5,635,795 | 6/1997 | Itoh et al. | 313/496 |
| 5,663,608 | 9/1997 | Jones et al. | 313/309 |
| 5,688,708 | 11/1997 | Kato et al. | 445/41 |
| 5,731,660 | 3/1998 | Jaskie et al. | 313/495 |
| 5,827,102 | 10/1998 | Watkins et al. | 445/25 |

OTHER PUBLICATIONS

Borgi, "St121 and St122 Porous Coating Getters," SAES Getters, Jul. 27, 1994, pp. 1–13.

Carella et al, "Gettering in Small Size Vacuum Microelectronic Devices," 7th Int'l Vacuum Microelec. Conf., Jul. 1994, 5 pp.

Ferrario et al, "A New Generation of Porous Non–Evaporable Getters," SAES Getters, Dec. 13, 1993, pp. 1–8.

Giorgi et al, "High–Porosity Thick–Film Getters," *IEEE Transactions on Electron Devices*, vol. 36, No. 11, Nov. 1989, pp. 2744–2746.

Heyder et al, "Nonevaporable Gettering Technology for In–Situ Vacuum Processes," *Solid State Technology*, Aug. 1996, pp. 71–74.

"Alkali Free and Low Alkali Thin Glasses", AF 45 and D 263, Deutsche Spezialglas AG ("DESAG"), Nov. 1995, 4 pp.

"St 175 Nonevaporable Porous Getters," SAES Getters, Aug. 17, 1994, pp. 1–6.

"Extend UV/IR Range Transmission Curves," *High Vacuum Elec. and Optical Ceramic–to–Metal Seal Components*, Insulator Seal Inc., 1995, p. 147.

*Primary Examiner*—Sandra O'Shea
*Assistant Examiner*—John A. Ward
*Attorney, Agent, or Firm*—Skjerven, Morrill, MacPherson, Franklin & Friel LLP; Ronald J. Meetin

[57] ABSTRACT

A getter (50) situated in a cavity of a hollow structure (40–46), such as a flat-panel device, is activated by directing light energy locally through part of a hollow structure and onto the getter. The light energy is typically provided by a laser beam (60). The getter, typically of the non-evaporable type, is usually inserted as a single piece of gettering material into the cavity. The getter normally can be activated/re-activated multiple times in this manner, typically during the sealing of different parts of the structure together.

38 Claims, 4 Drawing Sheets

LOCAL ENERGY ACTIVATION OF GETTER TYPICALLY IN ENVIRONMENT BELOW ROOM PRESSURE

FIELD OF USE

This invention relates to gettering—i.e., the collection and removal, or effective removal, of small amounts of gases from an environment typically at a pressure below room pressure. In particular, this invention relates to techniques for activating getters used in structures such as flat-panel devices.

BACKGROUND

A flat-panel device contains a pair of generally flat plates connected together through an intermediate mechanism. The two plates are typically rectangular in shape. The thickness of the relatively flat structure formed by the two plates and the intermediate connecting mechanism is small compared to the diagonal length of either plate.

When used for displaying information, a flat-panel device is typically referred to as a flat-panel display. The two plates in a flat-panel display are commonly termed the faceplate (or frontplate) and the baseplate (or backplate). The faceplate, which provides the viewing surface, is part of a faceplate structure containing one or more layers formed over the faceplate. The baseplate is similarly part of a baseplate structure containing one or more layers formed over the baseplate. The faceplate structure and the baseplate structure are sealed together, typically through an outer wall.

A flat-panel display utilizes various mechanisms such as cathode rays (electrons), plasmas, and liquid crystals to display information on the faceplate. In a flat-panel cathode-ray tube ("CRT") display, electron-emissive elements are typically provided over the interior surface of the baseplate. When the electron-emissive elements are appropriately excited, they emit electrons that strike phosphors situated over the interior surface of the faceplate which consists of transparent material such as glass. The phosphors then emit light visible on the exterior surface of the faceplate. By appropriately controlling the electron flow, a suitable image is displayed on the faceplate.

Electron emission in a flat-panel CRT display needs to occur in a highly evacuated environment for the display to operate properly and to avoid rapid degradation in performance. The enclosure formed by the faceplate structure, the baseplate structure, and the outer wall is thus fabricated in such a manner as to be at a high vacuum, typically a pressure of 10–7 torr or less for a flat-panel CRT display of the field-emission type. Any degradation of the vacuum can lead to various problems such as non-uniform brightness of the display caused by contaminant gases that degrade the electron-emissive elements. The contaminant gases can, for example, come from the phosphors. Degradation of the electron-emissive elements also reduces the working life of the display. It is thus imperative that a flat-panel CRT display be hermetically sealed, that a high vacuum be provided in the hermetically sealed (airtight) enclosure, and that the high vacuum be maintained thereafter.

A field-emission flat-panel CRT display, commonly referred to as a field-emission display ("FED"), is conventionally sealed in air and then evacuated through tubulation provided on the display. FIG. 1 illustrates how one such conventional FED appears after the sealing and evacuation steps are completed. The FED in FIG. 1 is formed with baseplate structure 10, faceplate structure 11, outer wall 12, and multiple spacer walls 13. The FED is evacuated through pump-out tube 14, now closed, provided at opening 15 in baseplate structure 10.

Getter 16, typically consisting of barium, is commonly provided along the inside of tube 14 for collecting contaminant gases present in the sealed enclosure. This enables a high vacuum to be maintained in the FED during its lifetime. Getter 16 is of the evaporable (or flashable) type in that the barium is evaporatively deposited on the inside of tube 14.

Getter 16 typically performs in a satisfactory manner. However, tube 14 protrudes far out of the FED. Accordingly, the FED must be handled very carefully to avoid breaking getter-containing tube 14 and destroying the FED. It is thus desirable to eliminate tube 14. In so doing, the location for getter 16 along the inside of tube 14 is also eliminated.

Simply forming an evaporable barium getter at a location along the interior surface of baseplate structure 10 or/and faceplate structure 11 is unattractive. Specifically, a getter typically needs a substantial amount of surface area to perform the gas collection function. However, it is normally important that the active-to-overall area ratio—i.e., the ratio of active display area to the overall interior surface area of the baseplate (or faceplate) structure—be quite high in an FED. Because an evaporable barium getter is formed by evaporative deposition, a substantial amount of inactive area along the interior surface of the baseplate structure or/and the faceplate structure would normally have to be allocated for a barium getter, thereby significantly reducing the active-to-overall area ratio. In addition, the active components of the FED could easily become contaminated during the getter deposition process. Some of the active FED components could become short circuited.

A non-evaporable getter is an alternative to an evaporable getter. A non-evaporable getter typically consists of a pre-fabricated unit. As a result, the likelihood of damaging the components of an FED during the installation of a non-evaporable getter into the FED is considerably lower than with an evaporable getter. While a non-evaporable getter does require substantial surface area, the pre-fabricated nature of a non-evaporable getter generally allows it to be placed closer to the actual display elements than an evaporable getter.

Non-evaporable getters are manufactured in various geometries. FIGS. 2*a* and 2*b* (collectively "FIG. 2") illustrate the basic geometries for two conventional non-evaporable getters manufactured by SAES Getters. See Borghi, "St121 and St122 Porous Coating Getters," SAES Getters, Jul. 27, 1994, pages 1–13. The getter in FIG. 2*a* consists of metal wire 18A covered by coating 19A of gettering material. The getter in FIG. 2*b* consists of metal strip 18B covered by coating 19B of gettering material. A porous mixture of titanium and a zirconium-containing alloy typically forms the gettering material in these two non-evaporable getters.

Upon being placed in a highly evacuated environment, each of the getters in FIG. 2 is activated by raising the temperature of getter coating 19A or 19B to a suitably high value, typically 500° C., for a suitably long activation time, typically 10 min. At constant activation time, the getter performance can be increased by raising the activation temperature. For the getters of FIG. 2, the activation temperature can be as high as 900–950° C. above which the getters may be permanently damaged. Alternatively, as the activation temperature is increased, equivalent performance can be achieved at reduced activation time. The opposite occurs as the activation temperature is lowered to as little as 350° C. below which the gettering performance of the getters in FIG. 2 is significantly curtailed.

A getter typically consists of a porous mixture of particles that sorb gases which contact the outer surfaces of the particles. When the non-evaporable getters of FIG. 2 are activated in a high vacuum environment, sorbed gases present on the outer surfaces of the getter particles diffuse into the bulk of the getter particles, leaving their outer surfaces free to sorb more gases. The amount of gas which can be accumulated in the bulk of getter particles that are accessible to the gases is typically much more than the maximum amount of gas that the getter can sorb on the outer surfaces of the accessible particles. When the accessible outer getter surface is filled or partially filled with sorbed gases, the getter can be re-activated in a high vacuum environment to transfer the gases on the accessible outer surface to the bulk of the getter particles and again leave the accessible outer surface free to sorb more gases. Re-activation can typically be performed a relatively large number of times.

Borghi mentions three ways of activating the getters of FIG. 2 under high vacuum conditions: (a) resistive heating, (b) RF heating, and (c) indirect heating. Resistive heating is performed by passing current through metallic conductor 18A or 18B to raise the temperature of getter coating 19A or 19B to the activation temperature. The current and accompanying power are relatively high during the activation process, facts that must be taken into account in utilizing resistive heating to activate the getters. Borghi also mentions that the getters can be activated during bake-out treatments of the vacuum devices that contain the getters.

Wallace et al, U.S. Pat. No. 5,453,659, discloses a getter arrangement for an FED in which the gettering material is distributed across the active area of the faceplate structure. As shown in FIG. 3, the faceplate structure in Wallace et al contains transparent substrate 20, thin electrically insulating layer 21, electrically conductive anode regions 22, and phosphor regions 23. Electrically insulating material 24 of greater thickness than anode regions 22 is situated in the spaces between regions 22. Gettering material 25 is situated on insulating material 24 and is spaced apart from phosphor regions 23. Wallace et al indicates that getter material 25 can be barium or a zirconium-vanadium-iron alloy.

Getter material 25 in Wallace is initially activated during assembly of the FED under high vacuum conditions at 300° C. Wallace et al also provides circuitry, including electrical conductors connected to getter material 25, for re-activating getter material 25.

The getter arrangement of Wallace et al appears relatively efficient in terms of area usage. However, getter material 25 is relatively complex in shape and requires manufacturing steps that could be unduly expensive. The necessity to maintain space between getter material 25 and phosphor regions 23 raises reliability concerns. The provision of circuitry to re-activate getter material 25 raises further reliability concerns and also further increases the fabrication cost. It would be desirable to have a simple technique for activating/re-activating a getter, especially one of relatively simple design, in a flat-panel device without raising the reliability concerns of Wallace et al, without incurring high getter installation costs, and without using an awkward getter-containing attachment such as the pump-out tubulation commonly used with evaporable getters in FEDs.

GENERAL DISCLOSURE OF THE INVENTION

The present invention employs local energy transfer to activate a getter. More particularly, in accordance with the invention, light energy is directed locally through a portion of a hollow structure, such as a flat-panel device, and onto a getter situated in a cavity of the structure to activate the getter and enable it to collect gases. The term "local" or "locally" as used here in describing an energy transfer means that the energy is directed selectively to certain material largely intended to receive the energy without being significantly transferred to nearby material not intended to receive the energy.

The local energy transfer is typically performed by directing a laser beam onto the getter. By activating the getter with a laser, the getter can be of relatively simple configuration. For example, a getter activated according to the present invention preferably consists of a single piece of gettering material, typically of the non-evaporable type, inserted into the cavity of the hollow structure before the activation step. The present invention thus avoids the reliability concerns and high manufacturing costs commonly associated with complex getter designs such as that of Wallace et al.

The hollow structure typically contains a pair of plate structures separated by an outer wall. The getter is typically inserted between the two plate structures. There is no need to place the getter in an adjoining tube, or other awkward antechamber, that extends relatively far away from the plate structures. The possibility of breaking such an awkward getter-containing mechanism and thereby destroying the flat-panel device or other product formed by the hollow structure is avoided in the invention.

The getter-activation process is normally performed by passing the laser beam through transparent material of one of the plate structures. Although the getter itself is raised to a highly elevated temperature, the energy transfer that occurs during the activation process normally does not cause any significant heating of the plate structures or the outer wall.

In particular, very little of the light energy of the impinging laser beam is absorbed directly by the transparent plate-structure material through which the laser beam passes. When the laser beam is scanned only once across each part of the getter, only a small part of the getter is at high temperature at any time so that radiation-produced secondary heating is very small. The absence of significant heating of the plate structures and outer wall in the invention is a large advantage over a resistively heated getter where a conductor that carries current for activating the getter would likely have to pass through the outer wall and where the energy transfer that arises from the attendant ohmic heating of the conductor could readily lead to melting of parts of the outer wall due to the high current needed to activate the getter.

The laser-based getter-activation step of the invention is generally performed in a closed environment where the pressure is below room pressure. The pressure in the closed environment is typically at a high vacuum level of $10^{-2}$ torr or less. Consequently, the present getter-activation technique is suitable for use in applications, such as flat-panel CRT displays, where a high vacuum is needed. Nonetheless, the getter-activation technique of the invention can be employed in devices, such as plasma displays or plasma-addressed liquid-crystal displays, where the pressure in the closed environment exceeds $10^{-2}$ torr, typically due to the presence of inert gases. In either case, the getter chemically sorbs gases present in the closed environment.

The closed environment can be achieved in various ways. For example, when the getter is situated between the two plate structures of the hollow structure, a hermetically sealed enclosure is typically formed by sealing the plate structures together through the outer wall upon setting the hollow structure at a suitable bias temperature, typically at least 200° C. Laser activation of the getter can be performed while the hollow structure is in a vacuum chamber at the bias temperature with the chamber pressure adjusted to vacuum level before or during the sealing operation. The vacuum chamber then forms the closed environment.

Laser activation of the getter is normally performed after hermetically sealing the plate structures together through the outer wall with the internal pressure in the sealed hollow structure set at vacuum level. The getter activation can be done while the hollow structure is approximately at the bias temperature, as the hollow structure is cooled down to approximately room temperature, and/or after cool down. In any of these cases, the sealed hollow structure forms the closed environment. Each activation after the initial activation is a re-activation.

In short, the present invention furnishes a simple technique for activating/re-activating a getter placed in a hollow structure such as a flat-panel device, especially a flat-panel display of the CRT type where a high vacuum is needed to achieve high display performance. Importantly, the getter can have a very simple configuration—e.g., a single strip of material. Installation and activation of the getter can be performed in an inexpensive manner.

Use of light energy for activating the getter facilitates re-activation and is relatively non-intrusive with respect to the materials that form the hollow structure. Activation/re-activation of the getter with light energy does not involve breaching a wall of the hollow structure. The invention avoids concerns that arise due to passage of electrical leads through a wall to access a getter. Consequently, the likelihood of damaging the hollow structure due to energy transfer during the activation process is very low in the invention. The laser-based getter-activation technique of the invention thus provides a large advance over the prior art.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

Figure 5A:
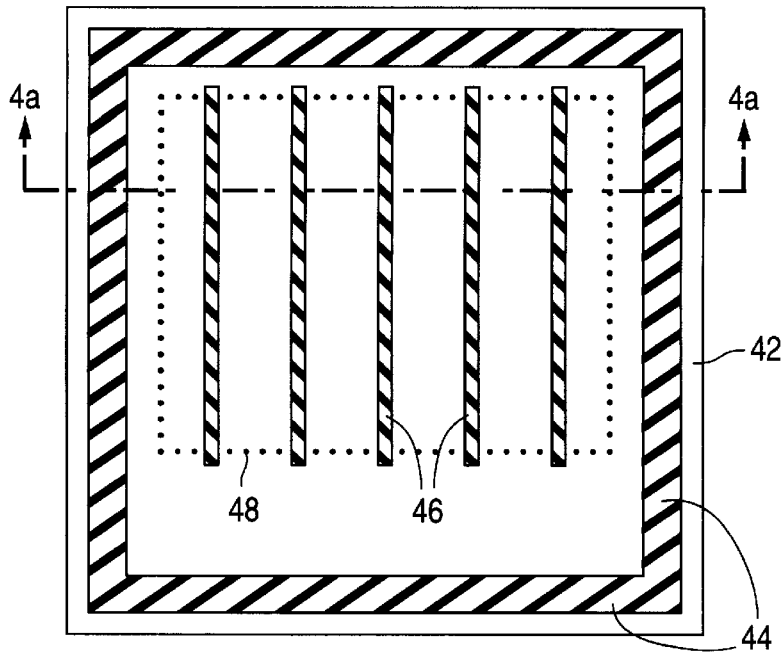
FIGS. 5*a* and 5*b* are respective cross-sectional plan views of the faceplate structure and overlying components in FIGS. 4*a* and 4*b*. The cross sections of FIGS. 5*a* and 5*b* are taken respectively through planes 5*a*—5*a* and 5*b*—5*b* in FIGS. 4*a* and 4*b*. The cross sections of FIGS. 4*a* and 4*b* are respectively taken through planes 4*a*—4*a* and 4*b*—4*b* in FIGS. 5*a* and 5*b*.
Figure 5B:
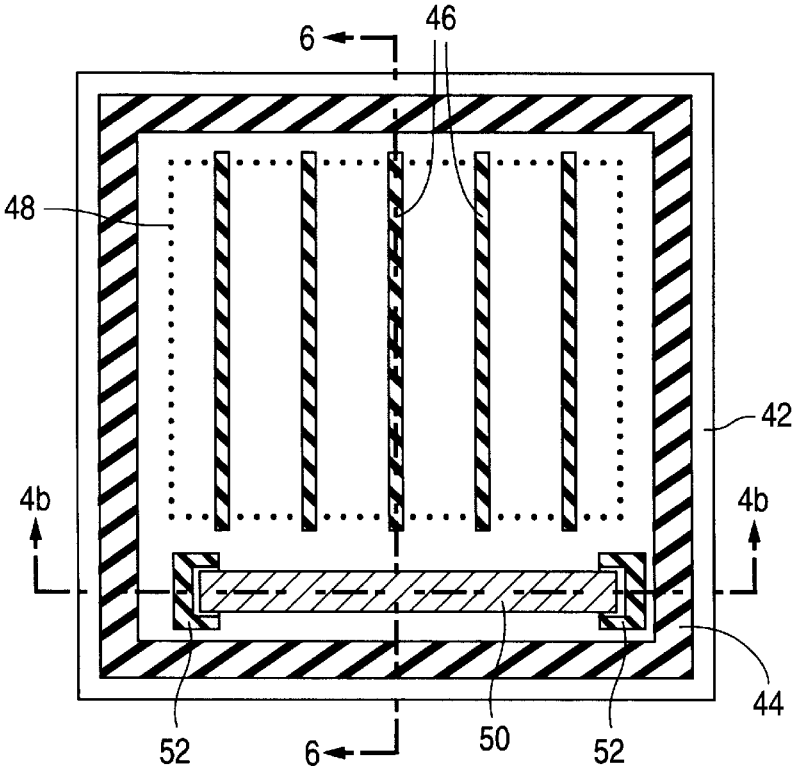
Figure 6:
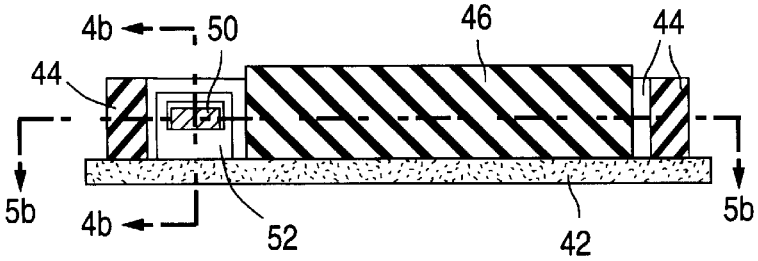
FIG. 6 is another cross-sectional side view of the faceplate structure and overlying components in FIGS. 4*b* and 5*b*. The cross section of FIG. 6 is taken through plane 6—6 in FIGS. 4*b* and 5*b*. The cross sections of FIGS. 4*b* and 5*b* are respectively taken through planes 4*b*—4*b* and 5*b*—5*b* in FIG. 6.

FIGS. 4*a*–4*h* (collectively "FIG. 4") illustrate how a non-evaporable getter of a flat-panel display is laser activated in accordance with the teachings of the invention during the assembly, including the hermetic sealing, of the display. Side views are generally presented in FIG. 4. FIGS. 5*a* and 5*b* (collectively "FIG. 5") depict top views of the faceplate structure and the overlying components of the flat-panel display at the stages respectively shown in FIGS. 4*a* and 4*b*. FIG. 6 illustrates a side view of the faceplate structure and overlying components at the stage shown in FIG. 4*b* but in a plane perpendicular to the plane of FIG. 4*b*.

As used herein, the "exterior" surface of a faceplate structure in a flat-panel display is the surface on which the display's image is visible to a viewer. The opposite side of the faceplate structure is referred to as its "interior" surface even though part of the interior surface of the faceplate structure is normally outside the enclosure formed by sealing the faceplate structure to a baseplate structure through an outer wall. Likewise, the surface of the baseplate structure situated opposite the interior surface of the faceplate structure is referred to as the "interior" surface of the baseplate structure even though part of the interior surface of the baseplate structure is normally outside the sealed enclosure formed with the two plate structures and the outer wall. The side of the baseplate structure opposite to its interior surface is referred to as the "exterior" surface of the baseplate structure.

With the foregoing in mind, the components of the flat-panel display assembled according to the process of FIG. 4 include a baseplate structure 40, a faceplate structure 42, an outer wall 44, and a group of spacer walls 46. Baseplate structure 40 and faceplate structure 42 are generally rectangular in shape. The internal constituency of plate structures 40 and 42 is not shown. However, baseplate structure 40 consists of a baseplate and one or more layers formed over the interior surface of the baseplate. Faceplate structure 42 consists of a transparent faceplate and one or more layers formed over the interior surface of the faceplate. Outer wall 44 consists of four sub-walls arranged in a rectangle. Spacer walls 46, which extend across active display area 48 as indicated in FIG. 5*a*, maintain a constant spacing between plate structures 40 and 42 in the sealed display and provide strength to the display.

A flat-panel display assembled according to the process of FIG. 4 can be any of a number of different types of high-vacuum flat-panel displays such as CRT displays and vacuum fluorescent displays as well as any one of a number of reduced-pressure flat-panel displays such as plasma displays and plasma-addressed liquid-crystal displays. In a flat-panel CRT display that operates according to field-emission principles, baseplate structure 40 contains a two-dimensional array of picture elements ("pixels") of electron-emissive elements provided over the baseplate. The electron-emissive elements form a field-emission cathode.

In particular, baseplate structure 40 in a field-emission display (again, "FED") typically has a group of emitter row electrodes that extend across the baseplate in a row direction. An inter-electrode dielectric layer overlays the emitter electrodes and contacts the baseplate in the space between the emitter electrodes. At each pixel location in baseplate structure 40, a large number of openings extend through the inter-electrode dielectric layer down to a corresponding one of the emitter electrodes. Electron-emissive elements, typically in the shape of cones or filaments, are situated in each opening in the inter-electrode dielectric.

A patterned gate layer is situated on the inter-electrode dielectric. Each electron-emissive element is exposed through a corresponding opening in the gate layer. A group of column electrodes, either created from the patterned gate layer or from a separate column-electrode layer that contacts the gate layer, extend over the inter-electrode dielectric in a column direction perpendicular to the row direction. The emission of electrons from the pixel at the intersection of each row electrode and each column electrode is controlled by applying appropriate voltages to the row and column electrodes.

Faceplate structure 42 in the FED contains a two-dimensional array of phosphor pixels formed over the interior surface of the transparent faceplate. An anode, or collector electrode, is situated adjacent to the phosphors in structure 42. The anode may be situated over the phosphors, and thus be separated from the faceplate by the phosphors. In this case, the anode typically consists of a thin layer of electrically conductive light-reflective material, such as aluminum, through which the emitted electrons can readily pass to strike the phosphors. The light-reflective layer increases the display brightness by redirecting some of the rear-directed light back towards the faceplate. U.S. Pat. Nos. 5,424,605 and 5,477,105 describe examples of FEDs having faceplate structure 42 arranged in the preceding manner. Alternatively, the anode can be formed with a thin layer of electrically conductive transparent material, such as indium tin oxide, situated between the faceplate and the phosphors.

When the FED is arranged in either of the preceding ways, application of appropriate voltages to the row and column electrodes in baseplate structure 40 causes electrons to be extracted from the electron-emissive elements at selected pixels. The anode, to which a suitably high voltage is applied, draws the extracted electrons towards phosphors in corresponding pixels of faceplate structure 42. As the electrons strike the phosphors, they emit light visible on the exterior surface of the faceplate to form a desired image. For color operation, each phosphor pixel contains three phosphor sub-pixels that respectively emit blue, red, and green light upon being struck by electrons emitted from electron-emissive elements in three corresponding sub-pixels formed over the baseplate.

Baseplate structure 40 is to be hermetically sealed to faceplate structure 42 through outer wall 44. At the stage shown in FIGS. 4*a* and 5*a*, outer wall 44 has been sealed (or joined) to faceplate structure 42. Outer wall 44 typically consists of frit arranged in a rectangular annulus. Spacer walls 44 are mounted on the interior surface of faceplate structure 42 within outer wall 44. Spacer walls 46 are normally taller than outer wall 44. The hermetic sealing of composite structure 42/44/46 to structure 40 is to be performed along (a) an annular rectangular sealing area formed by the upper edge 44S of outer wall 44 and (b) an annular rectangular sealing area 40S along the interior surface of baseplate structure 40.

Baseplate structure 40 is transparent along at least part of, normally the large majority of, sealing area 40S and the area where light energy for getter activation is to pass. Opaque electrically conductive (normally metal) lines in baseplate structure 40 typically cross sealing area 40S. Where such crossings occur, these opaque lines are sufficiently thin that they do not significantly impact the local transfer of light energy through structure 40.

A getter structure consisting of a non-evaporable getter strip 50 and a pair of thermally (and electrically) insulating getter supports 52 is installed over the interior surface of faceplate structure 42 within outer wall 44. See FIGS. 4*b*, 5*b*, and 6. As shown in FIG. 5*b*, getter structure 50/52 is situated outside active display area 48. Getter supports 52 are bonded to faceplate structure 42. The ends of non-evaporable getter strip 50 are situated in slot-shaped cavities located partway up the height of supports 52. The slots are slightly narrower than the width of supports 52. The slots are also slightly bigger than the getter width and thickness at the ends of getter strip 50 so as to allow room for thermal expansion.

With getter structure 50/52 so arranged, non-evaporable getter 50 is spaced apart from faceplate structure 42, outer wall 44, and spacer walls 46. Also, when baseplate structure 40 is bonded to faceplate structure 42 through outer wall 44, getter 50 will also be spaced apart from baseplate structure 40. This enables both the top and bottom surfaces of getter strip 50, along with its side edges, to provide gas collection action. Since getter supports 52 are thermal (and electrical) insulators, getter 50 is thermally (and electrically) insulated from faceplate structure 42, outer wall 44, and spacer walls 46 and will be thermally (and electrically) insulated from baseplate structure 40.

Figure 1:
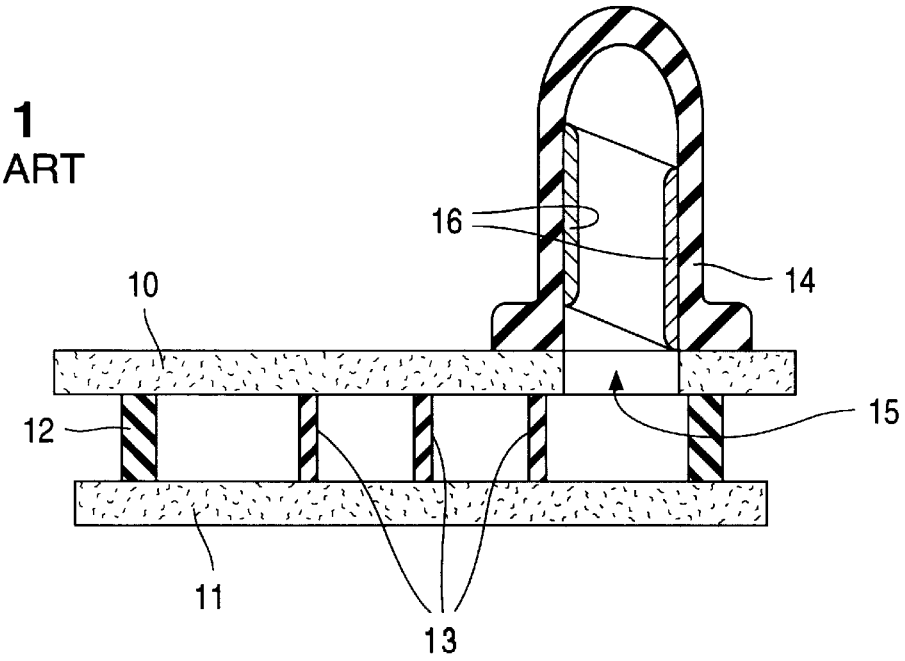
Fig. 1 PRIOR ART
FIG. 1 is a cross-sectional view of a conventional flat-panel CRT display having pump-out tubulation that contains an evaporable getter.
Figure 2A:
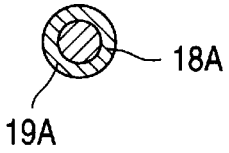
Fig. 2a PRIOR ART
FIGS. 2*a* and 2*b* are cross-sectional views of conventional non-evaporable getters.
Figure 2B:
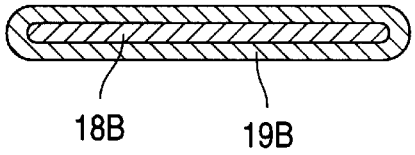
Fig. 2b PRIOR ART
Figure 3:
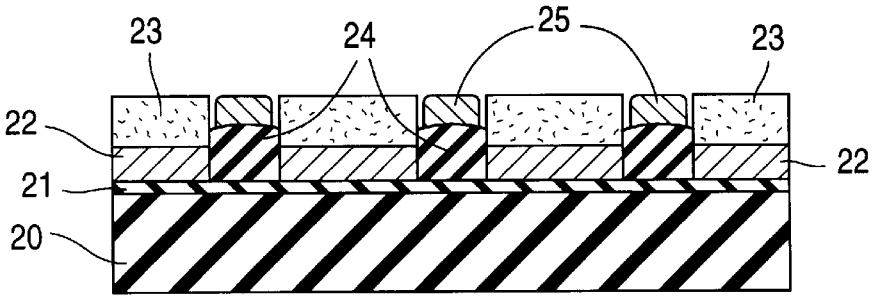
Fig. 3 PRIOR ART
FIG. 3 is a cross-sectional view of a getter-containing faceplate structure of a prior art flat-panel CRT display.

Non-evaporable getter 50 is typically configured internally as shown in FIG. 2*b*. Interior strip 18B usually consists of nichrome or nickel. Getter coating 19B consists of a porous mixture of titanium and either a gettering alloy of zirconium and aluminum or a gettering alloy of zirconium, vanadium, and iron. For example, getter 50 is typically a getter strip akin to the St121 or St122 getter strip available from SAES Getters. The thickness of interior strip 18B is 0.02–0.1 mm, while the total getter thickness is 0.1–0.5 mm. The getter width is in the vicinity of 2 mm.

The outside surface of getter 50 is normally chosen so as to be sufficiently large to provide adequate gettering capacity for the entire flat-panel display. If, however, the outside surface of getter 50 is insufficient to achieve the requisite gettering capacity in the space available for getter 50 in that part of the display, one or more additional getter structures configured similarly to getter structure 50/52 can be provided elsewhere over the interior surface of faceplate structure 42. For example, another such getter structure can be provided on the opposite side of active area 48 from where getter structure 50/52 is located. If there are advantages to small getter structures or limitations on fabricating large getter structures, one or more getter structures configured similarly to getter structure 50/52 can also be provided next to getter structure 50/52.

Getter supports 52 are normally slightly shorter than outer wall 44. Except for the slots that receive getter 50, supports 52 are generally rectangular solids. Supports 52 are typically formed by a suitable molding process. Pieces of suitable support material could also be machined to produce supports 52.

If getter strip 50 is so long that it is likely to bend and touch baseplate structure 40 or faceplate structure 42 due to the influence of gravity or/and other forces, one or more additional thermally (and electrically) insulating supports are provided along getter 50 to prevent it from touching structure 40 or 42. One part of each additional getter support lies between faceplate structure 42 and getter 50, while another part of each additional support overlies getter 50 so as to ensure that it is spaced apart from baseplate structure 40. Because the presence of additional getter supports occupies getter area, the number of additional getter supports is preferably kept as low as reasonable.

Figure 4A:
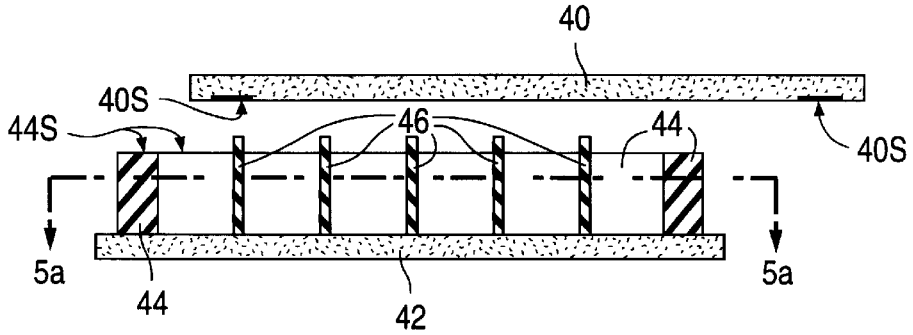
FIGS. 4*a*–4*h* are cross-sectional side views representing steps in laser activating a getter of a flat-panel display according to the invention.
Figure 4B:
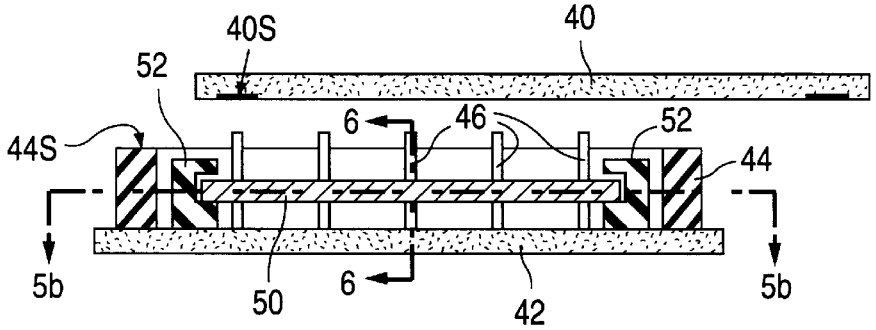
Figure 4C:
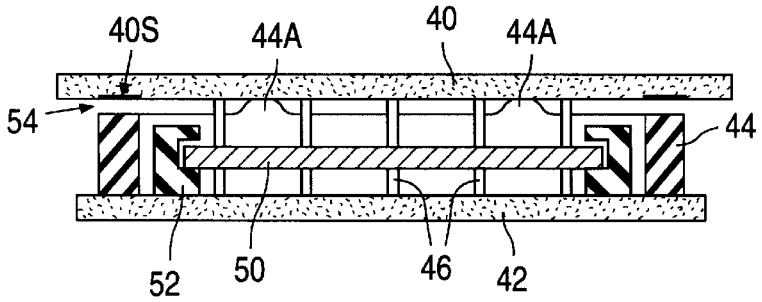

Using a suitable alignment system (not shown), structures 40 and 42/44/46/50/52 are positioned relative to one another in the manner shown in FIG. 4*c*. This entails aligning sealing areas 40S and 44S (vertically in FIG. 4*c*) and bringing the interior surface of baseplate structure 40 into contact with the upper edges of spacer walls 46. Because getter supports 52 are shorter than outer wall 44 and thus are shorter than spacer walls 46, baseplate structure 40 is spaced vertically apart from supports 52. The alignment is done optically in a non-vacuum environment, normally at room pressure, with alignment marks provided on plate structures 40 and 42 for aligning them, thereby causing sealing areas 40S and 44S to be aligned. Plate structures 40 and 42 and outer wall 44 now form a hollow structure having a cavity in which spacer walls 46 and getter structure 50/52 are situated. Spacer walls 46 are sufficiently taller than outer wall 44 that a gap 54 extends between sealing areas 44S and 40S.

With structures 40 and 42/44/46/50/52 situated in the alignment system, a tacking operation is performed to hold structure 40 in a fixed position relative to structure 42/44/46/50/52. In the process of FIG. 4, the tacking operation is typically performed with a laser (unshown) that tacks structure 40 to structure 42/44/46/50/52 at several locations along aligned sealing areas 40S and 44S. See FIG. 4*c*. The tacking operation causes portions 44A of outer wall 44 to protrude upward and become firmly bonded to baseplate structure 40. Techniques for performing the laser tacking operation and the subsequent gap-jumping final sealing operation are described in Cooper et al, co-filed U.S. patent application Ser. No. 08/766,474, U.S. Pat. No. 5,820,435, now U.S. Pat. No. 5,820,435, the contents of which are incorporated by reference to the extent not repeated herein.

Figure 4D:
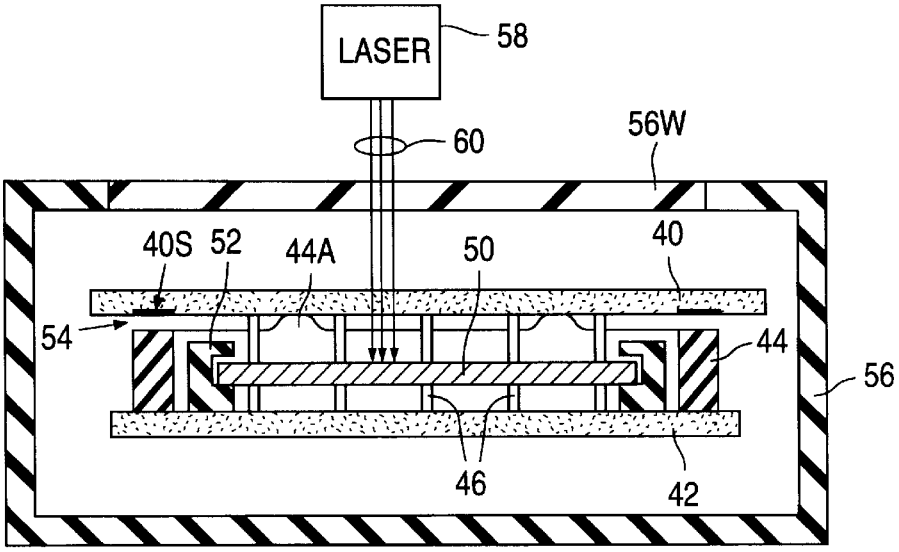

The tacked/partially sealed flat-panel display is removed from the alignment system and placed in a vacuum chamber 56, as shown in FIG. 4*d*, for laser activating getter 50 and performing other operations to complete the hermetic seal. Vacuum chamber 56 is pumped from room pressure down to a high vacuum at a pressure no greater than $10^{-2}$ torr, typically $10^{-6}$ torr or lower.

A laser 58 that produces a laser beam 60 is located outside vacuum chamber 56. Laser 58 is arranged so that laser beam 60 can pass through a transparent window 56W of chamber 56 and then through transparent material of baseplate structure 40 so as to impinge on getter 50. Window 56W typically consists of quartz.

The transparent material of baseplate structure 40 normally consists of glass. Laser beam 60 has a major wavelength at which the glass does not significantly absorb light energy. For example, when the transparent material of baseplate structure 40 consists of Schott D263 glass, the wavelength of laser beam 60 is in the approximate range of 0.3–2.5 $\mu$m across which Schott D263 glass strongly transmits light. As used here in connection with light transmission, "strongly" means at least 90% transmission. Consequently, very little of the thermal energy of laser beam 60 is transferred directly to baseplate structure 40 when laser beam 60 passes through the transparent material of structure 40. Nor is substantially any of the thermal energy of laser beam 60 normally transferred directly to faceplate structure 42, outer wall 44, or any of spacer walls 46.

Laser 58 can be implemented with any of a number of different types of lasers such as a semiconductor diode laser, a carbon dioxide laser (with the beam offset by 90°), an ultraviolet laser, or a neodymium YAG laser. For example, laser 58 is typically a diode laser such as the Optopower OPCA 015-810-FCPS continuous-wave integrated fiber-coupled diode laser module whose beam wavelength is approximately 0.85 $\mu$m. The laser power is typically 2–5 w. The width of getter strip 50 is typically no more than the diameter of laser beam 60. For a 2-mm width of getter 50, the diameter of beam 60 is typically 3 mm.

With the tacked structure at room temperature and with the pressure in chamber 56 at the high vacuum level, laser beam 60 is optionally scanned along the length of getter 50 to raise its temperature to a sufficient value to activate getter 50. The activation temperature is in the range of 300–950° C. More particularly, the activation temperature is 700–900° C., typically 800° C.

A single scan along the length of getter strip 50 is normally sufficient to activate all the gettering material of getter 50 as long as the diameter of laser beam 60 is at least the width of getter 50. If the diameter of beam 60 is so small compared to the width of getter strip 50 that some of the gettering material is likely not to be activated during a single laser scan, beam 60 can be scanned two or more times along different laterally separated paths that extend along the length of getter 50.

When laser 58 is operated in the preceding manner, each part of getter strip 50 is subjected directly to laser beam 60 only once. While the part of getter 50 immediately subjected to beam 60 is raised to a high temperature in activating that part of getter 50, the temperature of the activated part of getter 50 drops rapidly after beam 60 passes on. Consequently, only a small part of getter 50 is at a high temperature at any time. Secondary heating of components 40–46 by way of radiation from getter 50 is thus very small.

Using a heating element (not shown), the flat-panel display is raised to a bias temperature of 200–350° C., typically 300° C. The temperature ramp-up is usually performed in an approximately linear manner at a ramp-up rate in the vicinity of 3–5° C./min.

The components of the partially sealed flat-panel display outgas during the temperature ramp-up and during the subsequent "soak" time at the bias temperature prior to display sealing. The gases, typically undesirable, that were trapped in the display structure enter the unoccupied part of vacuum chamber 56, causing its pressure to rise slightly. To remove these gases from the enclosure that will be produced when baseplate structure 40 is fully sealed to composite structure 42/44/46/50/52, the vacuum pumping of chamber 56 is continued during the sealing operation in chamber 56. If activated, getter strip 50 assists in collecting undesired gases during the temperature ramp-up and subsequent soak.

Figure 4E:
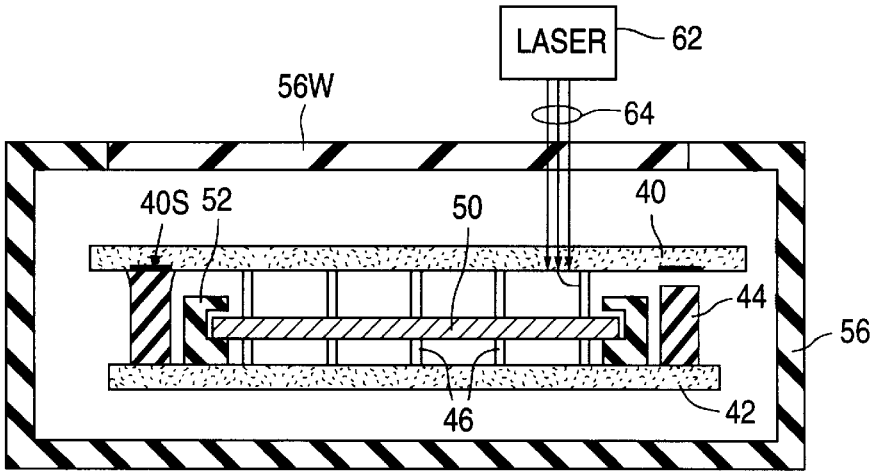

A laser 62 that produces a laser beam 64 is located outside vacuum chamber 56 as shown in FIG. 4*e*. Laser 62 may be the same as laser 58 depending on the factors such as the desired power level and beam diameter. Laser 62 is arranged so that beam 64 can pass through chamber window 56W and through transparent material of baseplate structure 40 along sealing area 40S.

With the pressure of vacuum chamber 54 at the high vacuum level and with the flat-panel display at the bias temperature, laser beam 64 is moved in such a way as to substantially fully traverse aligned sealing areas 40S and 44S. FIG. 4*e* illustrates how the flat-panel display appears at an intermediate point during the traversal of beam 64 along sealing areas 40S and 44S. If desired, beam 64 can skip tack portions 44A. As laser beam 64 traverses sealing areas 40S and 44S, light energy is transferred through baseplate structure 40 and locally to upper material of outer wall 44 along gap 54. The local energy transfer causes the material of outer wall 44 subjected to the light energy to melt and jump gap 54. The melted wall material along sealing area 44S hardens after beam 64 passes.

Getter strip 50 may be activated during the gap-jumping sealing operation using laser 58 in the manner described above. If getter 50 was activated prior to the final gap-jumping seal, this activation constitutes a re-activation. Also, if getter activation is performed during this step, laser 62 is normally a different laser from laser 58.

Gap 54 progressively closes during the sealing operation with laser 62. As gap 54 closes, the gases present in the enclosure being formed by the sealing of outer wall 44 to baseplate structure 40 escape from the enclosure through the progressively decreasing remainder of gap 54. Full closure of gap 54 occurs when beam 64 completes the rectangular traversal of sealing areas 40S and 44S.

Further contaminant gases are normally introduced into the unoccupied part of vacuum chamber 56 as a result of the display sealing process. Some of these gases will be present in the now-sealed compartment (cavity) formed by plate structures 40 and 42 and outer wall 44. Because the flat-panel display is sealed, the gases in sealed enclosure 40/42/44 cannot be removed by further vacuum pumping of chamber 56.

If getter strip 50 was activated prior to or/and during the final sealing operation (after pumping chamber 56 down to the desired vacuum level), getter 50 collected some of the gases present in sealed enclosure 40/42/44. However, in so doing, some of the gas-collection capability of getter 50 was used up.

Figure 4F:
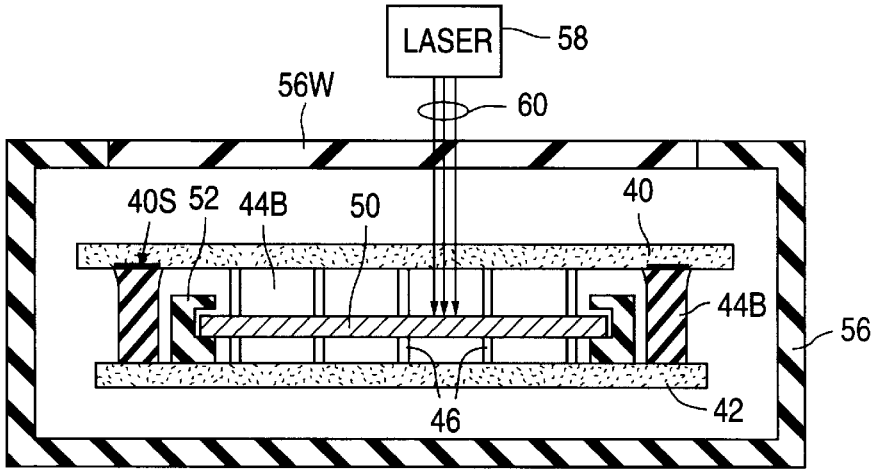

In any case, after completing the display sealing step and while the sealed flat-panel display is approximately at the bias temperature, laser 58 is normally employed to activate getter 50 in the manner described above. FIG. 4*f* illustrates the bias-temperature getter-activation step. If getter 50 was previously activated, this activation constitutes a re-activation.

The temperature of the sealed flat-panel display is subsequently returned to room temperature according to a cool-down thermal cycle that is controlled so as to avoid having the instantaneous cool-down rate exceed a selected value in the range of 3–5° C./min. The term "room temperature" here means the external (usually indoor) atmospheric temperature, typically in the vicinity of 20–25° C. Inasmuch as the natural cool-down rate at the beginning of the thermal cool-down cycle normally exceeds 3–5° C./min., heat is applied during the initial part of the cycle to maintain the cool-down rate at approximately the selected value in the range of 3–5° C./min. The heating is progressively decreased until a temperature is reached at which the natural cool-down rate is approximately the selected value, after which the flat-panel display is typically permitted to cool down naturally at a rate that progressively decreases to zero. Alternatively, a forced cool down can be employed during this part of the cool-down cycle to speed up the cool down.

Figure 4G:
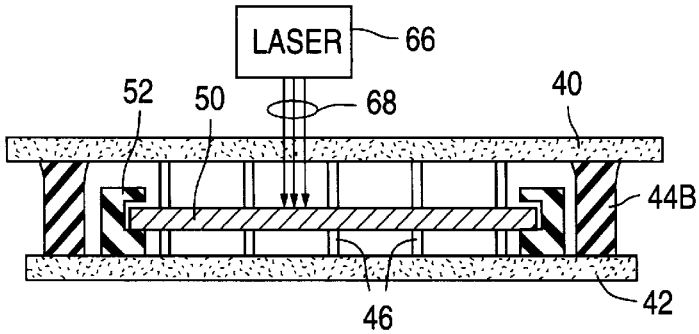

During the cool-down period, getter 50 can be activated/re-activated one or more times using laser 58 in the above-described manner to remove contaminant gases not previously collected and/or contaminant gases released during the sealing operation and cool down. The pressure in vacuum chamber 56 is subsequently raised to room pressure, and the fully sealed flat-panel display is removed from chamber 56. The term "room pressure" here means the external atmospheric pressure, normally in the vicinity of 1 atm. depending on the altitude. Alternatively, the chamber pressure can be raised to room pressure before cooling the sealed display down to room temperature. In either case, FIG. 4*g* illustrates the resulting structure. Item 44B in the sealed flat-panel display indicates the sealed shape of outer wall 44.

Part of the gettering capability of getter strip 50 is used up in collecting gases present in enclosure 40/42/44 after it is sealed and the flat-panel display is brought down to room temperature. Accordingly, getter 50 is re-activated after the temperature ramp-down is completed and the sealed flat-panel display is approximately at room temperature. The re-activation is performed with a laser 66 having a laser beam 68 as indicated in FIG. 4*g*.

The getter re-activation can be performed while the sealed flat-panel display is in vacuum chamber 56 or after removing the display from chamber 56. If the getter re-activation is done while the flat-panel display is in chamber 56, laser 66 is normally the same as laser 58. In this case, the re-activation is performed in the manner described above for activating (or re-activating) getter 50.

If the post cool-down re-activation is done after removing the flat-panel display from vacuum chamber 56, laser 66 is normally a separate laser arranged so that laser beam 68 passes through transparent glass of baseplate structure 40 and impinges on getter 50. As with laser beam 60, laser beam 68 has a wavelength at which the glass strongly transmits light. No significant heating of any of components 40–46 occurs during the re-activation. When laser 66 is a separate laser from laser 58, the re-activation of laser 66 is performed in substantially the same way as, and at very similar conditions to, the activation/re-activation with laser 58.

Figure 4H:
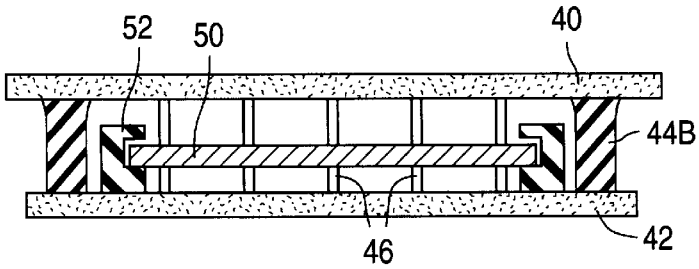

FIG. 4*h* illustrates how the flat-panel display appears after the post cool-down re-activation of getter 50 is complete. The sealed display with activated getter 50 is ready for the addition of external circuitry and/or incorporation into a television, video monitor, or other such image-presentation apparatus.

While the invention has been described with reference to particular embodiments, this description is solely for the purpose of illustration and is not to be construed as limiting the scope of the invention claimed below. For example, a getter akin to getter strip 50 can be situated in a sealed enclosure (cavity) of a reduced-pressure flat-panel device such as a plasma display or a plasma-addressed liquid-crystal display in which the pressure in the sealed enclosure is between room pressure and a high vacuum due to the presence of inert gas in the sealed enclosure. The inert gas is typically xenon, neon, helium, krypton, or/and argon. The pressure in the sealed enclosure of the reduced-pressure device is at least 1 torr, typically 5 torr to 0.5 atm.

The getter situated in the sealed enclosure of the reduced-pressure device is laser activated in the manner described above. The getter sorbs non-inert gases in the enclosure but does not sorb inert gases. Consequently, the presence of inert gas in the enclosure does not cause a significant part of the gettering capability to be expended. For the case in which the sealed enclosure is a plasma chamber, a plasma is typically created from the inert gas. The getter likewise does not collect ions of the inert gas.

Outer wall 44 can be formed with a rectangular annular non-frit portion sandwiched between a pair of rectangular annular frit layers. Non-evaporable getter strip 50 can be formed with materials other than a porous combination of titanium and a vanadium-containing alloy. Getter 50 can have shapes other than a strip. Getter supports 52 likewise can have different shapes than described above, provided that supports 52 thermally (and electrically) insulate getter 50 from the other display components. Getter supports 52 can be bonded to baseplate structure 40, rather than faceplate structure 42, prior to the alignment and sealing steps.

Getter 50 can be replaced with a getter of the evaporable type. Although getter supports 52 are typically eliminated in this case, the gettering material could be evaporatively deposited on material that thermally (and electrically) insulates the evaporable getter from the active display elements.

The flat-panel display can be hermetically sealed by techniques other than the gap-jumping technique of Cooper et al. As an example, the hermetic sealing operation can be performed by radiative heating in a vacuum oven. The flat-panel display can also be sealed by local heating with a laser after bringing the top edge of outer wall 44 substantially into contact with the interior surface of baseplate structure 40. The sealing operation can be performed at a pressure close to room pressure in a suitable neutral environment (e.g., dry nitrogen or an inert gas such as argon) after which the pressure in the sealed display is reduced to vacuum level by removing gas through a suitable port on the display, preferably a port that does not protrude out awkwardly from the sealed display. Outer wall 44 can be joined to baseplate structure 40 after which faceplate structure 42 is sealed to outer wall 44. Laser 58 and/or laser 62 can be located inside vacuum chamber 56.

The flat-panel CRT display can employ a thermionic-emission technique rather than a field-emission technique. The invention can be employed to activate getters in flat-panel devices other than displays. Getters situated in hollow structures other than flat-panel devices can be sealed by using the laser activation technique of the invention.

Light energy sources such as a focused lamp having a suitable spectral output can be employed in place of a laser for activating getter 50. Furthermore, getter 50 in a flat-panel CRT display can be activated/reactivated with any energy source that produces a sufficiently strong beam of energy which can be directed locally onto getter 50 without significantly heating components (such as baseplate structure 40 and/or a vacuum chamber window) through which the energy beam is intended to pass before reaching getter 50 and without having the beam impinge significantly on any other components of the CRT display except for the material through which the beam is intended to pass. Various modifications and applications may thus be made by those skilled in the art without departing from the true scope and spirit of the invention as defined in the appended claims.

We claim:

1. A method comprising the step of directing light energy locally through a specified portion of a hollow structure and onto a getter situated in a cavity of the hollow structure to activate the getter.

2. A method as in claim 1 wherein the energy-directing step entails directing a laser beam through the specified portion of the hollow structure and onto the getter.

3. A method as in claim 1 further including, prior to the energy-directing step, the step of inserting the getter, as a single piece of gettering material, into the cavity.

4. A method as in claim 1 wherein the gettering material is of non-evaporable type.

5. A method as in claim 1 wherein the hollow structure comprises a pair of plate structures and an outer wall that separates the plate structures.

6. A method as in claim 5 wherein the plate structures and the outer wall are components of a flat-panel display.

7. A method as in claim 6 further including, prior to the energy-directing step, the step of inserting the getter into the cavity so that the getter is located between the two plate structures.

8. A method as in claim 7 wherein the specified portion of the hollow structure comprises transparent material of one of the plate structures.

9. A method as in claim 6 wherein the energy-directing step is performed before or while sealing the plate structures together through the outer wall to form a hermetically sealed enclosure.

10. A method as in claim 6 wherein the energy-directing step is performed after sealing the plate structures together through the outer wall to form a hermetically sealed enclosure.

11. A method comprising the step of directing light energy locally onto a getter situated in a closed environment at a pressure below room pressure to activate the getter.

12. A method as in claim 11 wherein the pressure in the closed environment reaches a maximum vacuum level no greater than $10^{-2}$ torr during the energy-directing step.

13. A method as in claim 12 wherein the energy-directing step entails directing a laser beam onto the getter.

14. A method as in claim 13 further including, prior to the energy-directing step, the step of inserting the getter, as a single piece of gettering material, into the closed environment.

15. A method as in claim 14 wherein the gettering material is of non-evaporable type.

16. A method as in claim 13 wherein, during the energy-directing step, the getter is situated between two plate structures of a hollow structure that includes an outer wall located between the two plate structures.

17. A method as in claim 16 wherein the laser beam passes through transparent material of a specified one of the plate structures.

18. A method as in claim 16 wherein the getter comprises a strip of gettering material.

19. A method as in claim 16 wherein the energy-directing step is performed while the hollow structure is at an internal pressure no greater than $10^{-2}$ torr after hermetically sealing the two plate structures together through the outer wall with the hollow structure at a bias temperature of at least 200° C.

20. A method as in claim 19 wherein the energy-directing step is performed after cooling the hollow structure to approximately room temperature.

21. A method as in claim 19 wherein the energy-directing step is performed while cooling the hollow structure to approximately room temperature.

22. A method as in claim 21 further including, subsequent to cooling the hollow structure to approximately room temperature, the step of directing light energy of a laser beam onto the getter to re-activate the getter.

23. A method as in claim 19 wherein the energy-directing step is performed while the hollow structure is approximately at the bias temperature.

24. A method as in claim 23 further including, while or after cooling the hollow structure to approximately room temperature, the step of directing light energy of a laser beam onto the getter to re-activate the getter.

25. A method as in claim 16 wherein the energy-directing step is performed while the hollow structure is in a vacuum chamber at a bias temperature of at least 200° C., while the vacuum chamber is at a chamber pressure no greater than $10^{-2}$ torr, and before or while hermetically sealing the two plate structures together through the outer wall.

26. A method as in claim 25 further including subsequent to hermetically sealing the two plate structures together through the outer wall, the step of directing light energy of a laser beam onto the getter to re-activate the getter.

27. A method as in claim 26 wherein the energy-directing step for re-activating the getter is performed while or after cooling the hollow structure to approximately room temperature.

28. A method as in claim 26 wherein the energy-directing step for re-activating the getter is performed while the hollow structure is approximately at the bias temperature after hermetically sealing the two plate structures together through the outer wall.

29. A method as in claim 28 further including, subsequent to the energy-directing step for re-activating the getter and while or after cooling the hollow structure to approximately room temperature, the step of directing light energy of a laser beam onto the getter to further re-activate the getter.

30. A method as in claim 16 wherein the plate structures and outer wall are components of a flat-panel display for which one of the plate structures contains a faceplate on which an image produced by the flat-panel display is visible.

31. A method as in claim 30 further including, prior to the energy-directing step, the steps of:

providing multiple electron-emissive elements in one of the plate structures; and providing multiple light-emitting elements in the other of the plate structures, the light-emitting elements emitting light upon being struck by electrons emitted from the electron-emissive elements.

32. A method as in claim 31 wherein the electron-emissive elements operate in field-emission mode.

33. A method as in claim 11 wherein the pressure in the closed environment is greater than $10^{-2}$ torr during the energy-directing step.

34. A method as in claim 33 wherein the closed environment is formed by a cavity of a hollow structure, the cavity containing inert gas.

35. A method as in claim 34 further including the step of forming a plasma in the cavity.

36. A method as in claim 35 wherein the pressure in the cavity is at least 1 torr.

37. A method comprising the steps of:

providing multiple electron-emissive elements in a first plate structure;

providing multiple light-emitting elements in a second plate structure that includes a faceplate, the light-emitting elements emitting light upon being struck by electrons emitted from electron-emissive elements;

sealing the two plate structures together through an outer wall to form a hermetically sealed flat-panel display with a getter situated inside the display, an image produced by the light-emitting elements being visible on the faceplate during operation of the display; and directing energy locally through a specified portion of the display to activate the getter.

38. A method as in claim 37 wherein the energy-directing step entails directing a laser beam through the specified portion of the display and onto the getter.

* * * * *